US005826874A

United States Patent [19]

Teitell et al.

[11] Patent Number: 5,826,874

[45] Date of Patent: Oct. 27, 1998

[54] MAGNETIC GOLF CLUB SWING SENSOR AND GOLF SIMULATOR

[75] Inventors: Murray Teitell, Manhattan Beach; David G. Pelka, Westchester, both of Calif.; Mathiew Bais, Southlake, Tex.

[73] Assignee: VR Sports, Inc., Manhattan Beach, Calif.

[21] Appl. No.: 791,329

[22] Filed: Jan. 31, 1997

Related U.S. Application Data

[63] Continuation-in-part of Ser. No. 745,740, Nov. 12, 1996, Pat. No. 5,728,006.

[51] Int. Cl.[6] ..... A63B 69/36

[52] U.S. Cl. ..... 473/225

[58] Field of Search ..... 473/150, 151, 473/152, 155, 219, 220, 221, 222, 223, 224, 225, 226

[56] References Cited

U.S. PATENT DOCUMENTS

| | | | |
|---|---|---|---|
| 5,108,105 | 4/1992 | Shimizu | 473/225 |
| 5,114,150 | 5/1992 | Matsumura | 473/222 |
| 5,728,006 | 3/1998 | Teitell et al. | 473/151 |

*Primary Examiner*—William H. Grieb
*Attorney, Agent, or Firm*—Martin D. Lerner

[57] ABSTRACT

The golf game system of the present invention includes at least two magnetic induction coil sensors to simulate the speed and the direction of a golf swing by a golfer. A magnetic strip adhesively attached to the end of the golf club locates the position of the golf club with respect to the sensors. An electronic circuitry panel translates the information provided by the magnetic induction coil sensors into information that is acceptable to the customized software package. The magnetic sensing system interfaces with standard software packages for a personal computer to allow a user to swing a real golf club and have the results entered and displayed by the software package. In one preferred embodiment of the invention, the magnetic sensing system and electronic circuitry panel interfacing with the personal computer are integrated into a golf mat. The magnetic induction coil sensors may be flat induction coils built into the mat to minimize mat thickness. The golf mat further may include means to select functions such as the number of the golf club from the software package without returning to the mouse of the personal computer. The selection means may be realized with a 'magnetic mouse' integrated into the golf mat so that the golfer may position the cursor on the computer screen by moving the golf club around an area of the golf mat. Magnetic sensors in the golf mat interact with the magnet on the end of the golf club to position of the cursor over the desired function from the software package, and the golfer may then click on that function with a switch or button on the golf mat.

15 Claims, 2 Drawing Sheets

MAGNETIC GOLF CLUB SWING SENSOR AND GOLF SIMULATOR

BACKGROUND OF THE INVENTION

The present application is a Continuation-in-Part of U.S. patent application Ser. No. 08/745,740, filed Nov. 12, 1996, entitled "Magnetic Golf Club Swing Sensor and Golf Simulator" by inventors Murray Teitell and David G. Pelka, now U.S. Pat. No. 5,728,006.

This invention relates to a simulation system for golf games. Games currently exist on the market that simulate the game of golf on a personal computer. In these games, the player uses a joystick or mouse/keyboard combination to initiate a golf swing, and the computer calculates the ball trajectory based on the length of time that the mouse and joystick are held. Other devices use this computer golf game in combination with a real golf club held by the user as an input into the computer game to therefore simulate the swing of the user. Such devices enable the user to simulate the game of golf, possibly as an instructional aid to teach people to improve their golf swing, and to provide a more realistic way to practice the game of golf. The computer screen displays the result of the golfer's swing based upon parameters input into the computer by sensors located on the swing sensor unit. It is thus possible with existing computer golf software for a game player to effectively play a full eighteen holes of golf without the inconvenience of actually getting to a golf course. Such a computer golf game might also be used as a novelty item in sports bars for those who are not regular golfers.

U.S. Pat. No. 5,472,205, to Bouton, describes such a golf game system that interfaces with existing computer software and uses electro-optical sensors to measure the golfer's swing. One disadvantage of the system of Bouton is that it relies on light emitting diodes and photodetectors that are mounted on the floor of the driving surface or on vertical posts. If the golf club were to accidently hit either the light emitting diodes or the detectors, the system could be severely damaged since both light emitting diodes and detectors are relatively fragile semiconductor devices. Furthermore, the use of optical energy as the vehicle of sensing in Bouton leads to the possibility of stray light contaminating the sensing system, and inaccurate simulation results. Particularly, the Bouton device seems to be unreliable in accurate simulation of putting.

The Bridgestone ScienceEye HD-01 is a device that uses magnetic sensors to detect and display the speed of a golf club. The Bridgestone device is placed on the floor near where the golf club is to be swung, but does not interface with a computer or any software program to display the speed or direction of the golf ball. In Bridgestone, the display is in the form of a numerical liquid crystal display that is integral with the golf sensing unit. Thus, the Bridgestone unit is not intended to be used with a simulation system.

The present golf game system also interfaces with existing computer software and employs detectors to measure the golfer's swing. However, the present device employs magnetic sensing means instead of optical sensing means, and as a result is more durable, rugged and reliable. While magnetic sensing means are generally known in the prior art, they have not been used in conjunction with golf game simulation systems. The present golf game system does not need fragile light emitting diodes because it uses only a flexible magnet on the surface of the golf club to provide an indication of the golf club position. Moreover, the magnetic sensors of the present golf game system are generally more rugged and durable than photosensors so that the overall game is more reliable than one that is based on visible light. Furthermore, the use of magnetic sensors eliminates the problem of stray light, making the overall game more reliable particularly in putting situations, where slow movement of the club might produce significant stray reflections.

II. SUMMARY OF THE INVENTION

It is therefore the object of this invention to produce a more durable and reliable version of a simulated golf game in conjunction with a personal computer by utilizing a magnetic sensor system.

In one embodiment, a magnetic sensor system and an electronic circuitry panel are built into a golf mat.

In a further embodiment of the present invention, the golf mat incorporates one or more switches that select and adjust golf game functions from the golf simulation software without requiring the golfer to return to the computer.

In one particular embodiment, golf game functions are selected from the golf simulation software with a magnetic mouse that adjusts the position of the cursor on the computer screen by moving the magnet on the end of the golf club around a particular area on the golf mat.

The invention is a simulated golf game system that responds to a player swinging a club. The game includes a golf club having a flexible magnetic tape attached to the head of the golf club, a plurality of magnetic sensing units to detect the speed and direction of the golf club, an electronic circuitry panel for converting the inputs received by the magnetic sensor, a software package for interpreting the results from the electronic circuitry and calculating the game output, and a personal computer for running the software package and displaying the results. One important feature of the electronic circuitry panel is that it is electromagnetically shielded within a box housing. This eliminates the problem of environmental electromagnetic energy interfering with the operation of the circuit.

The electronic circuitry panel in a preferred embodiment employs a clock and a counter to detect the speed of the golf club. In another preferred embodiment, the electronic circuitry panel employs a comparator circuit to determine whether the ball is hit to the left or the right. The software package includes customized software in assembly language to interface the outputs of the magnetic sensors with the existing golf game software.

The present invention provides an improved configuration over prior simulated golf game systems by placing the magnetic sensor system underneath or within a golf mat that lies on the floor. By integrating the magnetic sensor system within the golf mat it becomes possible to remove the sensors from view and to prevent the golfer from accidently hitting the sensor module with the golf club during the golf swing, which could damage the sensors within the module. It is also possible to integrate the electronic circuitry panel within the golf mat, either with or without integrating the magnetic sensors. By utilizing a golf mat, it becomes possible to provide markings on the surface of the mat indicating the direction of swing, the position where the tee is located, et cetera. In a preferred embodiment, the number of magnetic sensors within the golf mat is four. Two of these sensors lie along the line in the direction of the swing and measure the speed of the golf club. Two other magnetic sensors lie to the left and right of these and measure the hook and slice motion of the golf club. In order to reduce the thickness of the combination of the golf mat and magnetic sensors, flat disk-shaped magnetic induction coils as used as magnetic sensors instead of the conventional vertical magnetic induction coils.

Another advantage of using the golf mat of the present invention is that it optionally includes additional functions built into the mat to interface with the golf simulation software. An example of this is the selection of clubs. When a golfer desires to change golf clubs with the standard commercially available golf simulation software, he must return to computer where he positions and clicks the mouse to change the number of the club. In the present invention, a club selection switch may be built into the golf mat so that the golfer can merely tap on the switch with the golf club to toggle to the desired golf club number. The golf mat contains a display area that indicates the golf club number selected by the golfer. Other functions of the golf simulation software may be similarly built into the golf mat.

In one preferred embodiment, the golf mat includes the function of a magnetic mouse. By building the mouse function into the golf club, it becomes possible for the golfer to position the cursor on the computer screen simply by moving the golf club around a particular area of the golf mat. The magnet on the end of the golf club interacts with additional magnetic sensors inside the golf mat and sends electronic signals to the computer to reposition of the cursor on the computer screen to the desired window function of the computer software. Once the desired software function is found, the golfer then clicks a switch on the golf mat to select or adjust the function. The magnetic mouse of the present invention is thus analogous to the rotating ball and click system that is sometimes found on the keyboard of a personal computer. By the inclusion of a magnetic mouse function within the golf mat it becomes possible to select any number of golf game parameters from the windows-based computer software without multiplying the number of switches or buttons on the golf mat. In another embodiment, the cursor positioning function is realized with arrow buttons or switches that are incorporated into the golf mat. The buttons or switches may be of any conventional variety such as pressure or heat sensitive switches, or they may be magnetic switches that are activated by the magnet on the end of the golf club. By incorporating the mouse function into the golf mat, the golfer need not leave the driving/putting area and return to the computer to adjust the functions of the simulated golf game. This is particularly advantageous in some applications where the electrical cable connecting the magnetic sensors and circuitry to the computer is especially long, as in a sports bar where the display is a big screen tv.

III. BRIEF DESCRIPTION OF THE DRAWINGS

FIG. 4 shows an embodiment where the electronic circuitry and additional functions are built into the golf mat but the magnetic sensors remain above the golf mat.

IV. DETAILED DESCRIPTION OF THE REFERRED EMBODIMENTS

Figure 1:
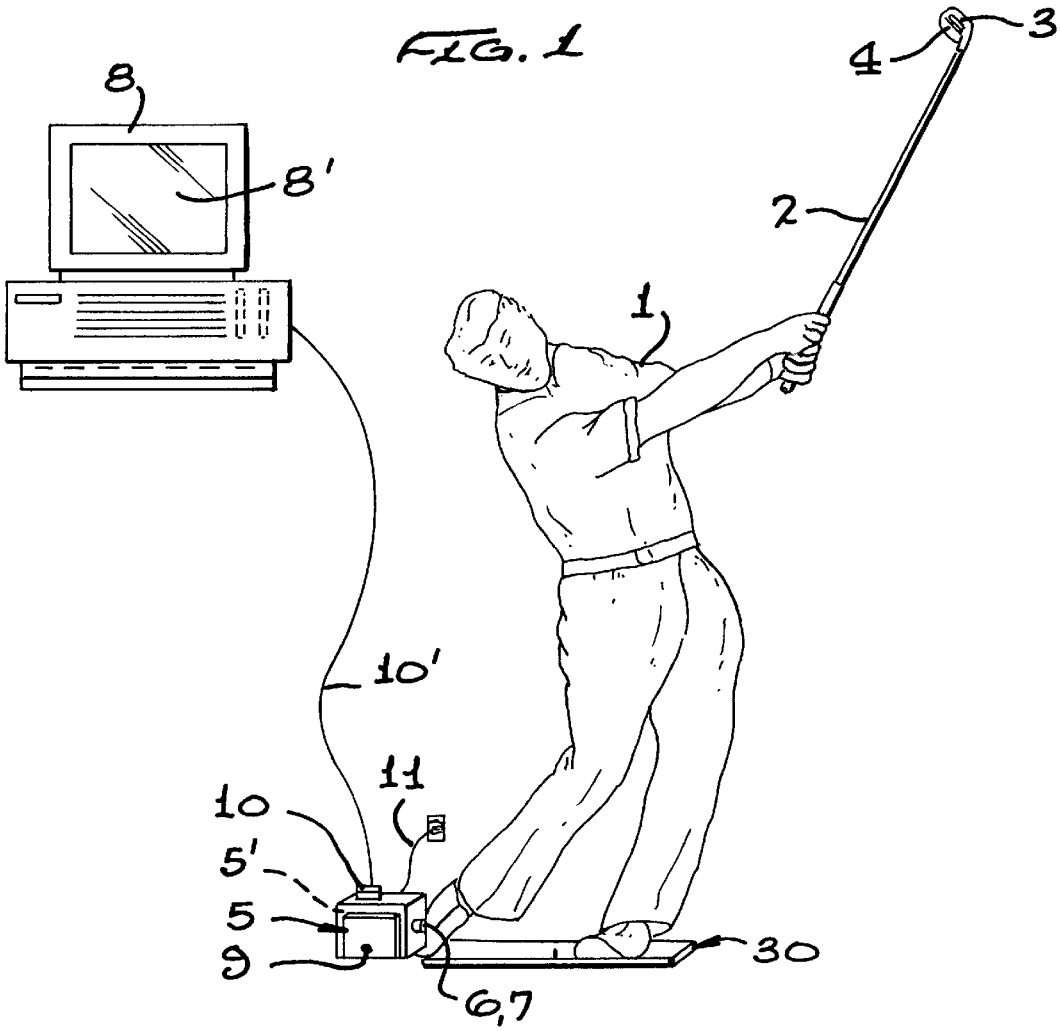
FIG. 1 is an illustration of the golf game system of the present invention.

FIG. 1 shows a golf system where a player 1 is swinging a golf club 2 having a flexible magnet 3 adhesively attached to the surface 4 of the golf club 2. Box 5 contains a pair of magnetic sensors 6, 7 and the electronic circuitry 5' to convert the output of the magnetic sensors 6, 7 into a format that can be understood by the personal computer 8. The magnetic sensors 6, 7 of the preferred embodiment are of a particular low resistivity design to increase the sensitivity of the device. Magnetic sensors that are 6 VDC, 32 ohm inductance coils were found to work particularly well. Box 5 also has a swing light 9, a computer connector port 10 and cord 10', and an input for a power source 11. In a preferred embodiment, the computer connector port 10 is of the parallel 25 pin type. Also, in the preferred embodiment, a distance of about 2.75 inches separates the magnetic sensors 6, 7. The power source 11 can either be AC or DC, utilizing a household line voltage with a transformer or four 1.5 volt batteries. The box 5 is made from a metallic or other type of material that acts to shield the magnetic sensors 6, 7 from electromagnetic energy that is in the environment and that could potentially interfere with the operation of the simulator, particularly large screen televisions, indoor fluorescent lights, and other indoor electromagnetic radiation sources.

In actually application, the golfer 1 swings his golf club 2 and the speed at which the club 2 moves past the two sensors 6, 7 is converted by a clock 18 and counter 22 in the electronic circuitry 5' into a series of pulses that enter the computer 8. The clock pulses of the magnetic sensor system are a translation of mouse pulses that would have been generated by the software game without a real club input. A software package, in this case written in assembly language, converts the outputs from the clock into the analogous mouse pulses that are recognized by the game software. This interface software is included as a computer disk sold with the hardware of the present invention. This interface software is initially installed onto the hard drive of the personal computer and is activated via a 'startup' or 'autoexec batchfile' before or along with the proprietary, commercially-available golf game simulation software. The proprietary golf game software used in a particular embodiment, Links by Access Software Incorporated, Salt Lake City, Utah, requires mouse inputs that determine the distance of the backswing and the distance of the foreswing. The swing speed and clocks outputs from the box 5 are sent to the personal computer, and the interface software of the present invention converts this information into an acceptable format for the Links program that results in an accurate simulation of the golfer's swing.

It is also possible to choose a particular club that is used for a particular hole. Furthermore, the hole is optionally set or set by the software as is the lie of the green, and as is the golf course as a whole. The display device 8' for the personal computer 8 can be a liquid crystal display, a cathode ray tube, a projection television system, or a head mounted virtual reality display system. The game system can also be used in a non-game practice mode, such as a simulator of a driving range or a putting green.

In the golf game system of the present invention it is also possible to sense the direction of the golf club 2 using only the aforementioned pair of sensors 6, 7. In this case a comparator circuit is employed to monitor whether the golf club 2 is closer to one or other of the sensors 6, 7 during the course of the swing. If the club 2 is closer to the back sensor 6 than the front sensor 7 during the course of the swing, then the club 2 is moving from right to left, for example; if the club 2 is farther from the back sensor 6 than the front sensor 7, then the club 2 is moving from left to right. The direction of club movement is then translated into the hook (left) or slice (right) motion of the golf ball. The comparator circuit compares the peak values of the output from the magnetic sensors 6, 7 to determine which of the two sensors 6, 7 the club 2 is closer to, and converts this into signals that the particular software application can understand.

Figure 2:
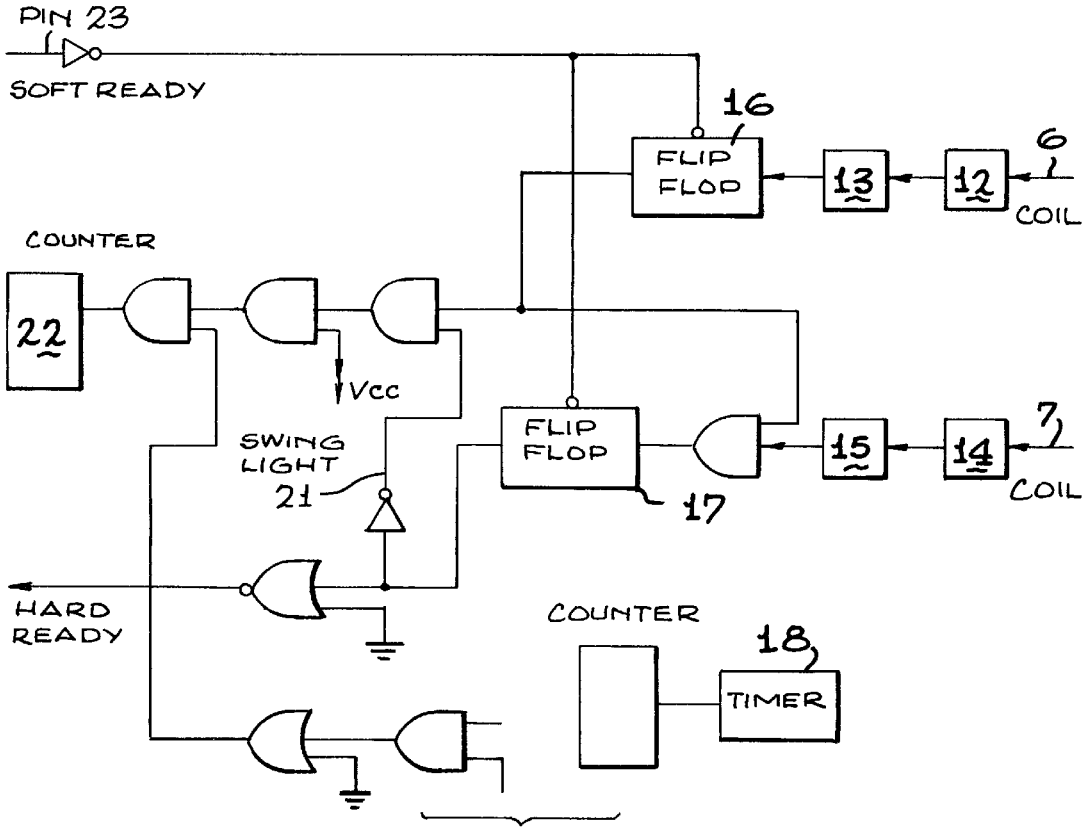
FIG. 2 is a block diagram of the electronic circuitry that converts the output of the magnetic sensors into a format that can be understood by a personal computer.

FIG. 2 shows a block diagram of the circuitry 5' that is used to convert information from the magnetic sensors 6, 7 into information that can be used by the personal computer software. When the software in the personal computer 8 is ready, pin 23 supplies a Soft Ready signal that resets the flipflops 16, 17 and turns on the swing light 21, indicating that the golfer 1 may start to play. When the golfer 1 begins the swing, magnetic sensor 6 detects the golf club 2, and the signal is sent to amplifiers 12, 13 and then to a flipflop 16. Meanwhile, timer 18 is running, and flipflop 16 turns on counter 22. When the golf club 2 passes magnetic sensor 7, the signal is sent to amplifiers 14, 15, and activates flipflop 17. The output from flipflop 17 stops the counter 22, and at the same time provides the Hard Ready signal to the software. The Hard Ready signal is sent to the software to tell the personal computer 8 that it can now read the swing data.

Figure 3:
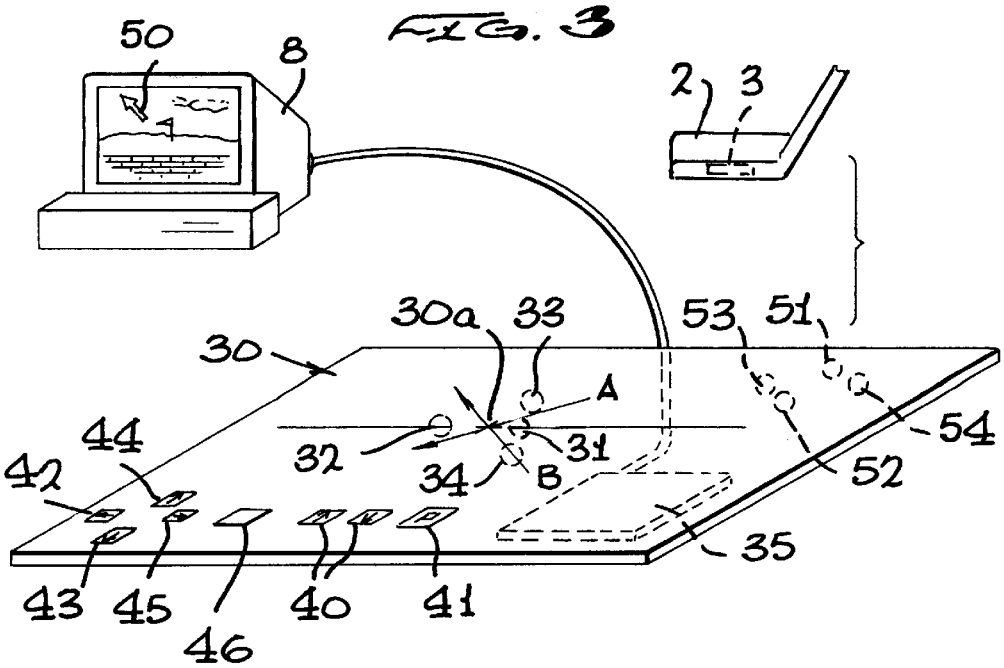
FIG. 3 is an illustration of the embodiment where the magnetic sensors, electronic circuitry and a magnetic mouse function are built into a golf mat.
Figure 1:
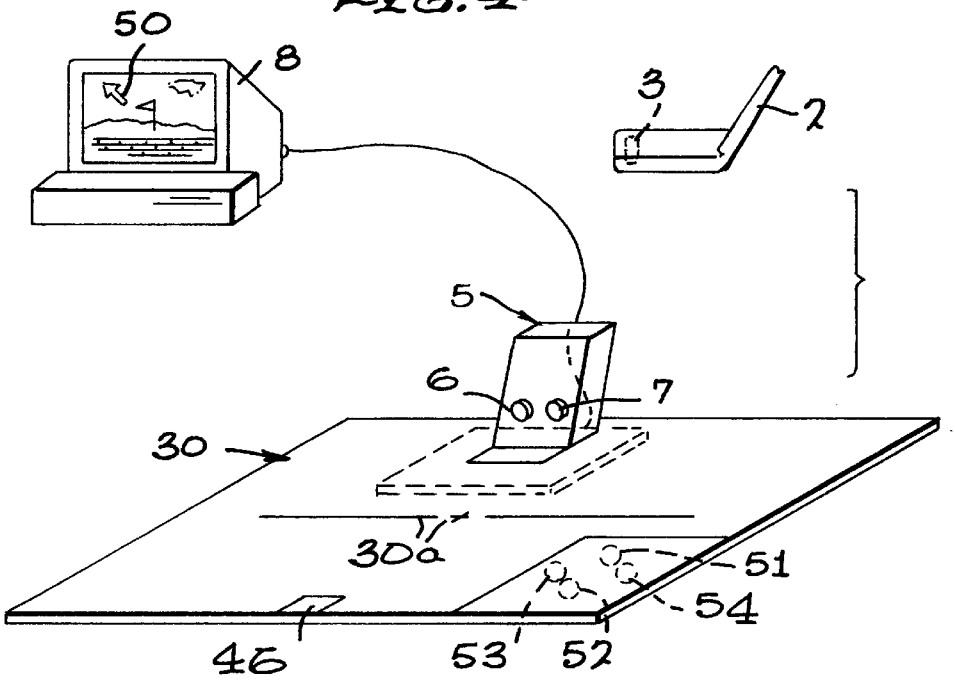

FIG. 3 shows an embodiment where the magnetic sensors 31, 32, 33, and 34 are built into a golf mat 30. Magnetic sensors 31, 32, 33, 34 interact with the flexible magnet 3 adhesively attached now to the bottom surface of golf club 2 to sense the speed and direction of the golfer's swing. Golf mat 30 may itself be of any conventional design including but not limited to indoor-outdoor carpet, artificial grass, rubber or plastic, and may typically be about one foot wide (1') by two feet (2') long with a thickness of about one inch (1"). FIG. 3 shows indicia 30*a* on the mat 30 indicating the preferred line of swing and position of the golf tee. Magnetic sensors 31, 32, 33 and 34 may be formed on the underside of mat 30 or may even be cast within the volume of mat the rubber or plastic of the mat 30 at the time that mat 30 is initially made. Electronic circuitry 35 is similarly shown to be incorporated on the underside of the mat 30. Magnetic sensors 31, 32, 33 and 34 are of the type utilizing flat magnetic induction coil construction in order to minimize the total thickness of the mat 30 in combination with the sensors 31, 32, 33 and 34. FIG. 3 shows four such magnetic sensors 31, 32, 33 and 34 so that hook and slice information can be extracted from the golf swing, but it may be possible to produce the required information with either more or fewer magnetic sensors. The illustrated design shows the four sensors in the shape of the letter 'T', but it may be possible to obtain the required result with only three sensors arranged in a triangle, or the four sensors may be arranged in a cross-shape or other pattern. Sensors 31 and 32 lie in the preferred direction of the golf swing and measure the speed of the golf swing in the manner previously described. Because sensors 31, 32 now lie within the surface of the golf mat 30, it is now necessary to add two other magnetic sensors 33, 34 to extract information about the hook and slice motion of the golfer's swing. When the golfer's swing lies along line A in FIG. 3, from upper right to lower left for a right-handed golfer, the strength of the magnetic signal is greater at sensor 33 than it is at sensor 34, and the electronic circuitry 35 provides information that produces a hook in the game simulation. When the golfer's swing lies along line B, from lower right to upper left, the strength of the magnetic signal is greater at sensor 34 than it is at sensor 33, and the electronic circuitry 35 provides information that produces a slice in the game. The relative magnitudes of the magnetic signals from sensors 33 and 34 is compared in a manner similar to that previous disclosed to determine the degree of the hook or slice.

FIG. 3 further illustrates various means incorporated into the surface of the mat 30 for changing the parameters of the golf game simulation software without the golfer 1 having to return to his personal computer 8. One of the most common parameters that the golfer must change as he plays a hole is the number of the golf club. FIG. 3 shows an embodiment where a switch or button 40 is incorporated into the surface of the golf mat 30 along with a display 41 for changing the setting of the number of the golf club at the site of the mat 30. Switch or button 40 can be a pressure sensitive switch that the golfer 1 can toggle with the end of his golf club 2, or it can be a magnetic or heat-sensitive switch.

The commercially-available golf simulation software that is used in combination with the present invention, however, has a number of further functional features that require selection and setting, and it is advantageous to be able to adjust these functions as well. Some examples of these functions are the "mulligan" which allows the golfer to play over a shot, and the "drop" which allows the golfer to extract the ball when it has entered into a simulated hazard. It is possible to incorporate further switches and/or buttons into the golf mat 30, but ultimately this will produce a costly increase in hardware and will not permit the golf game simulation to operate in the 'windows' software environment, particularly where the software may be improved over time to include further functions. It is thus desirable to have a mouse feature built into the golf mat 30 so that the golfer 1 doesn't have to return to personal computer 8 every time a function is changed. FIG. 3 shows one embodiment where four arrow keys 42, 43, 44 and 45 are incorporated into the mat 30. Arrow keys 42 to 45 may be any type of the switches or buttons previously described. Golfer 1 positions the cursor 50 on the screen of the personal computer 8, perhaps by tapping the arrows keys 42 to 45 with the end of his golf club 2 until the cursor 50 is located over the correct function position on the screen of the personal computer. The golfer 1 then taps selection key 46 any number of times on the desired software function to adjust the function parameter in a manner analogous to what is performed by a mouse button.

FIG. 3 further illustrates a 'magnetic mouse' feature. Instead of buttons or switches, a 'magnetic' mouse' makes use of the magnet 3 on the bottom surface of golf club 2 to adjust the position of the cursor 50 on the screen of the personal computer 8. Golfer 1 moves the golf club 2 and the position of the club 2 is detected by a plurality of magnetic sensors integrated into an area of mat 30. These magnetic sensors may be the same magnetic sensors 31 to 34 that were previously used to measure the speed, hook and slice motion of the golf swing, or additional magnetic sensors 51, 52, 53 and 54 may be provided. The comparative strength of the signals from the four magnetic sensors 51 to 54 shown in FIG. 3 are converted by the electronic circuitry 35 into a form that is acceptable to the personal computer 8 by imitating the signals produced by the rotating ball on the underside of a mouse to position the cursor.

FIG. 4 shows an embodiment similar to that just described, but where the magnetic sensors 6, 7 are not incorporated into the surface of the mat 30, but where the electronic circuitry panel 35 is so incorporated. However, magnetic sensors 51, 52, 53 and 54 here provide 'magnetic mouse' cursor position. Magnetic sensors 6, 7 are placed in box 5. One advantage of keeping the sensors 6, 7 separate from the mat 30 is the reduction in the required number of magnetic sensors since two sensors suffice to provide hook and slice information in this arrangement. Another advantage is that the sensors 51 to 54 of the mouse may be magnetically isolated from the sensors 6, 7 for the speed, hook and slice.

The golf game system of the present invention is not limited to the disclosed particulars of the preferred embodiments, but is intended to encompass all variants and modifications within the scope and spirit of the invention.

We claim:

1. A golf game system for sensing the swing of a golf club, and providing information about the swing of said golf club to a personal computer running a golf game software package, comprising:

a flexible magnetic strip adhesively attached to an end surface of said golf club;

at least two magnetic sensing means for detecting information about motion of said golf club by sensing velocity and path of said magnetic strip;

electronic circuit means for converting the information from said pair of magnetic sensing means into signals that are input into said personal computer;

a golf mat incorporating said magnetic sensing means or said electronic circuit means, or both said magnetic sensing means and said electronic circuit means, within said mat;

a computer cable for transmitting information from said electronic circuit means to said personal computer.

2. The golf game system of claim 1, further comprising:

a customized software package means installed via a computer disk supplied with said golf game system;

said software package being installed on the hard disk of said personal computer so as to interface with said golf game software package and convert signals from said electronic circuit means into a format that is acceptable to said golf game software package.

3. The golf game system of claim 1, further comprising:

means for adjusting game parameters from said golf game software, wherein said means for adjusting game parameters is incorporated into said golf mat.

4. The golf game system of claim 3, wherein:

said means for adjusting game parameters are switches or buttons on the surface of said golf mat.

5. The golf game system of claim 3, wherein:

said means for adjusting game parameters includes means for changing the selection of said golf club.

6. The golf game system of claim 3, wherein:

said means for adjusting game parameters includes means for changing the location of a cursor on a display screen of said personal computer.

7. The golf game system of claim 6, wherein:

said means for changing the location of said cursor are a plurality of magnetic sensing elements incorporated into an area of said golf mat, whereby said cursor is positioned on said display screen of said personal computer by changing the location of said golf club having said flexible magnetic strip with respect to said plurality of magnetic sensing elements.

8. The golf game system of claim 1, wherein:

said at least two magnetic sensing means are incorporated into said golf mat, said at least two magnetic sensing means being flat magnetic inductance coils.

9. A golf game system for sensing the swing of a golf club, and providing information about the swing of said golf club to a personal computer running a golf game software package, comprising:

a flexible magnetic strip adhesively attached to an end surface of said golf club;

at least two magnetic sensing means for detecting information about motion of said golf club by sensing velocity and path of said magnetic strip;

electronic circuit means for converting the information from said pair of magnetic sensing means into signals that are input into said personal computer;

a golf mat incorporating means for adjusting game parameters from said golf game software;

a computer cable for transmitting information from said electronic circuit means to said personal computer.

10. The golf game system of claim 9, further comprising:

a customized software package means installed via a computer disk supplied with said golf game system;

said software package being installed on the hard disk of said personal computer so as to interface with said golf game software package and convert signals from said electronic circuit means into a format that is acceptable to said golf game software package.

11. The golf game system of claim 9, wherein:

said means for adjusting game parameters are switches or buttons on the surface of said golf mat.

12. The golf game system of claim 9, wherein:

said means for adjusting game parameters includes means for changing the selection of said golf club.

13. The golf game system of claim 9, wherein:

said means for adjusting game parameters includes means for changing the location of a cursor on a display screen of said personal computer.

14. The golf game system of claim 13, wherein:

said means for changing the location of said cursor are a plurality of magnetic sensing elements incorporated into an area of said golf mat, whereby said cursor is positioned on said display screen of said personal computer by changing the location of said golf club having said flexible magnetic strip with respect to said plurality of magnetic sensing elements.

15. The golf game system of claim 9, wherein:

said at least two magnetic sensing means are incorporated into said golf mat, said at least two magnetic sensing means being flat magnetic inductance coils.

* * * * *